US007824127B1

(12) United States Patent
Shunn et al.

(10) Patent No.: US 7,824,127 B1
(45) Date of Patent: Nov. 2, 2010

(54) ROAD REPAIR TRACTOR AND METHOD OF USING THE SAME

(75) Inventors: Richard Lee Shunn, Canby, OR (US); Gell Wesley Shunn, Mulino, OR (US); Jeffrey Lee Shunn, Kingman, AZ (US)

(73) Assignee: S-2 Contractors Inc., Aurora, OR (US)

( * ) Notice: Subject to any disclaimer, the term of this patent is extended or adjusted under 35 U.S.C. 154(b) by 682 days.

(21) Appl. No.: 11/823,626

(22) Filed: Jun. 27, 2007

(51) Int. Cl.
*E01C 19/42* (2006.01)

(52) U.S. Cl. ..... 404/75; 404/96; 404/101; 37/407

(58) Field of Classification Search ..... 404/75, 404/96, 101; 37/381, 407
See application file for complete search history.

(56) References Cited

U.S. PATENT DOCUMENTS

| | | | | |
|---|---|---|---|---|
| 2,169,987 | A * | 8/1939 | Mosel | 404/75 |
| 3,541,934 | A | 11/1970 | Borgquist et al. | 94/46 |
| 4,507,012 | A * | 3/1985 | Corcoran et al. | 404/72 |
| 4,723,609 | A | 2/1988 | Curtis | 172/815 |
| 4,802,293 | A * | 2/1989 | Smith | 37/381 |
| 5,273,375 | A | 12/1993 | Plourde | 404/118 |
| 5,599,135 | A * | 2/1997 | Delaurenti | 404/101 |
| 5,697,731 | A | 12/1997 | Bonds | 404/92 |
| 6,086,287 | A * | 7/2000 | Sharpe et al. | 404/75 |
| 6,367,177 | B1 | 4/2002 | Mullen | 37/407 |
| 6,526,678 | B2 * | 3/2003 | Waddington, Jr. | 37/406 |

FOREIGN PATENT DOCUMENTS

| | | |
|---|---|---|
| JP | 07087804 A | 4/1995 |
| JP | 07227665 | 5/1995 |
| WO | WO 2005/083185 A1 | 9/2005 |

* cited by examiner

*Primary Examiner*—Gary S Hartmann
(74) *Attorney, Agent, or Firm*—Timothy E. Siegel Patent Law, PLLC

(57) ABSTRACT

A road repair tractor adapted for smoothing asphalt that has been laid into a work-trench, dug in a roadway. The tractor includes a body supporting an engine and defining a cockpit. Also, laterally spaced first and second support and motive force assemblies are operatively driven by the engine and support the body. A smoothing device is supported by the body and has a width that is adjustable from a most narrow width of between 10 cm and 30 cm to a widest width of between 1 meter and 2.5 meters. The smoothing device also includes a smoothing blade assembly, having a bottom edge, deployed between a pair of asphalt side-spill guards. Finally, a power actuating system includes controls located in the cockpit that permit a user seated in the cockpit to change the adjustable width of the smoothing device and to raise and lower the smoothing device relative to the body.

12 Claims, 5 Drawing Sheets

ROAD REPAIR TRACTOR AND METHOD OF USING THE SAME

BACKGROUND

It is typical for pipes of various types to be positioned underneath a street. When one of these pipes requires repair, it is necessary to dig a trench in the street to access the pipe. This trench is later filled most of the way with gravel. Either a single layer or multiple layers of asphalt must then be laid on top of the gravel to repair the street.

The asphalt is first poured from a truck so that it runs lengthwise inside the trench. Then a crew of workmen equipped with rudimentary hand tools smoothes out the asphalt. The top layer is also compressed by a heavy roller, typically a power roller.

As of 2007, these workmen are typically paid an hourly wage of about $37/hr in the United States, depending on the local. Accordingly, the time consuming work of smoothing out the asphalt in the course of repairing a trench constituted a significant expense to contractors performing this kind of work, and to the local governments that pay them.

U.S. Pat. No. 5,273,375 appears to show an asphalt smoothing device that can be attached to the shovel of a back hoe. This device, however, does not appear to be capable of being lowered into a trench, because it would be blocked by a pair of outwardly extending horizontal plates. Moreover, the presence of the back hoe shovel would serve to block the view of the operator and it appears that the width of the device cannot be adjusted by the operator, unless he leaves his seat in the backhoe. Accordingly, this device does not aid in the task of smoothing asphalt that has been laid into a trench as much as would be desirable.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect, the present invention may take the form of a method of smoothing asphalt that has been laid into a trench, to a desired level. The method uses a tractor having laterally spaced first and second support and motive force assemblies. The tractor is equipped with a smoothing device that has an adjustable width and that includes a smoothing blade assembly, having a bottom edge, deployed between a pair asphalt side-spill guards. Also, the smoothing device is vertically moveable relative to the motive force assemblies. The support and motive force assemblies are used to move the tractor so that it bridges the trench, and is supported by the first support and motive force assembly on a first side of the trench and the second support and motive force assembly on a second side of the trench. Then, the smoothing device is moved vertically so that the bottom edge of the smoothing blade assembly is at the desired level and it is also width adjusted, to approximately match the width of the trench. Finally, the support and motive force assemblies are used to push the tractor forward, thereby causing the smoothing device to push any asphalt above the desired level forward, thereby leaving only asphalt at or below the desired level.

In a second separate aspect, the present invention may take the form of a road repair tractor adapted for smoothing asphalt that has been laid into a work-trench, dug in a roadway. The tractor includes a body supporting an engine and defining a cockpit adapted to accommodate a person. Also, laterally spaced first and second support and motive force assemblies are operatively driven by the engine and support the body. A smoothing device is supported by the body and has a width that is adjustable from a most narrow width of between 40 cm and 80 cm to a widest width of between 1 meter and 2.5 meters. The smoothing device also includes a smoothing blade assembly, having a bottom edge, deployed between a pair asphalt side-spill guards. Finally, a power actuating system includes controls located in the cockpit that permit a user seated in the cockpit to change the adjustable width of the smoothing device and to raise and lower the smoothing device relative to the body.

In a third separate aspect, the present invention may take the form of a road repair assembly, including a roadway having a top surface. Also, a trench has been dug into the roadway and a line of asphalt has been laid into the trench, a first portion of the asphalt being smoothed and a second portion of the asphalt not being smoothed. A tractor that has laterally spaced first and second support and motive force assemblies also has a smoothing device that includes a smoothing blade assembly, having a bottom edge and a front surface, deployed between a pair asphalt side-spill guards. The tractor is positioned with the first support and motive force assembly on a first side of the trench and the second support and motive force assembly on a second side of the trench so that the tractor bridges the trench. Finally, the bottom edge of the smoothing blade assembly is in the trench below the top surface of the roadway and is between the first portion and the second portion of the asphalt and has a pile of asphalt on the front surface.

In addition to the exemplary aspects and embodiments described above, further aspects and embodiments will become apparent by reference to the drawings and by study of the following detailed descriptions.

BRIEF DESCRIPTION OF THE FIGURES

Exemplary embodiments are illustrated in referenced figures of the drawings. It is intended that the embodiments and figures disclosed herein are to be considered illustrative rather than restrictive.

DETAILED DESCRIPTION OF THE PREFERRED EMBODIMENTS

Figure 1:
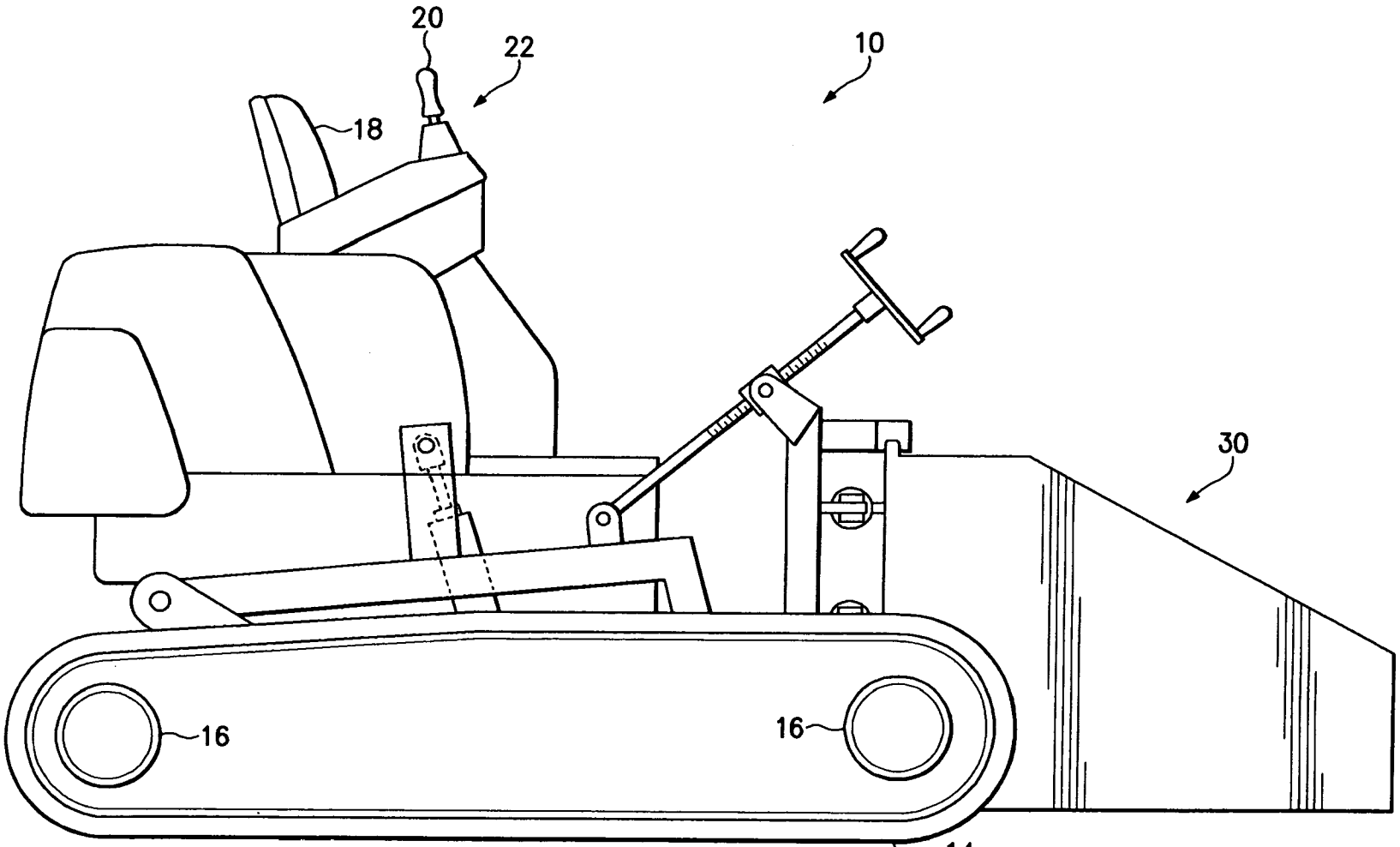
FIG. 1 is a side elevation view of a road repair tractor, according to the present invention.

Referring to FIG. 1, a road repair tractor 10 according to a preferred embodiment of the present invention includes a pair of support and motive force assemblies 12, in the form of a pair of tread assemblies, including tread 14 and drive wheels 16. A seat 18 and a control suite, including lever 20 and an additional lever (not shown), collectively form a cockpit 22. Finally, a smoothing device 30 forms the front of tractor 10.

Figure 2:
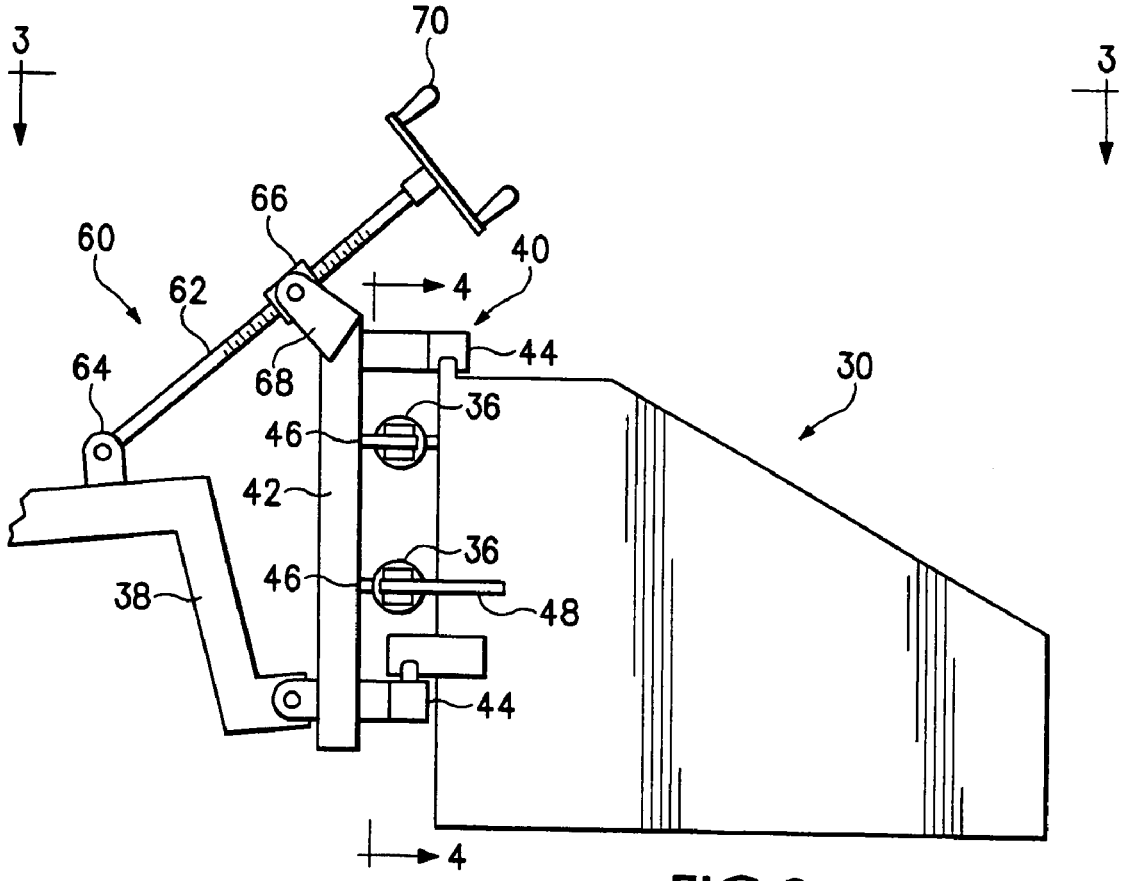
FIG. 2 is a side elevation view of the central front portion of the tractor of FIG. 1.
Figure 3A:
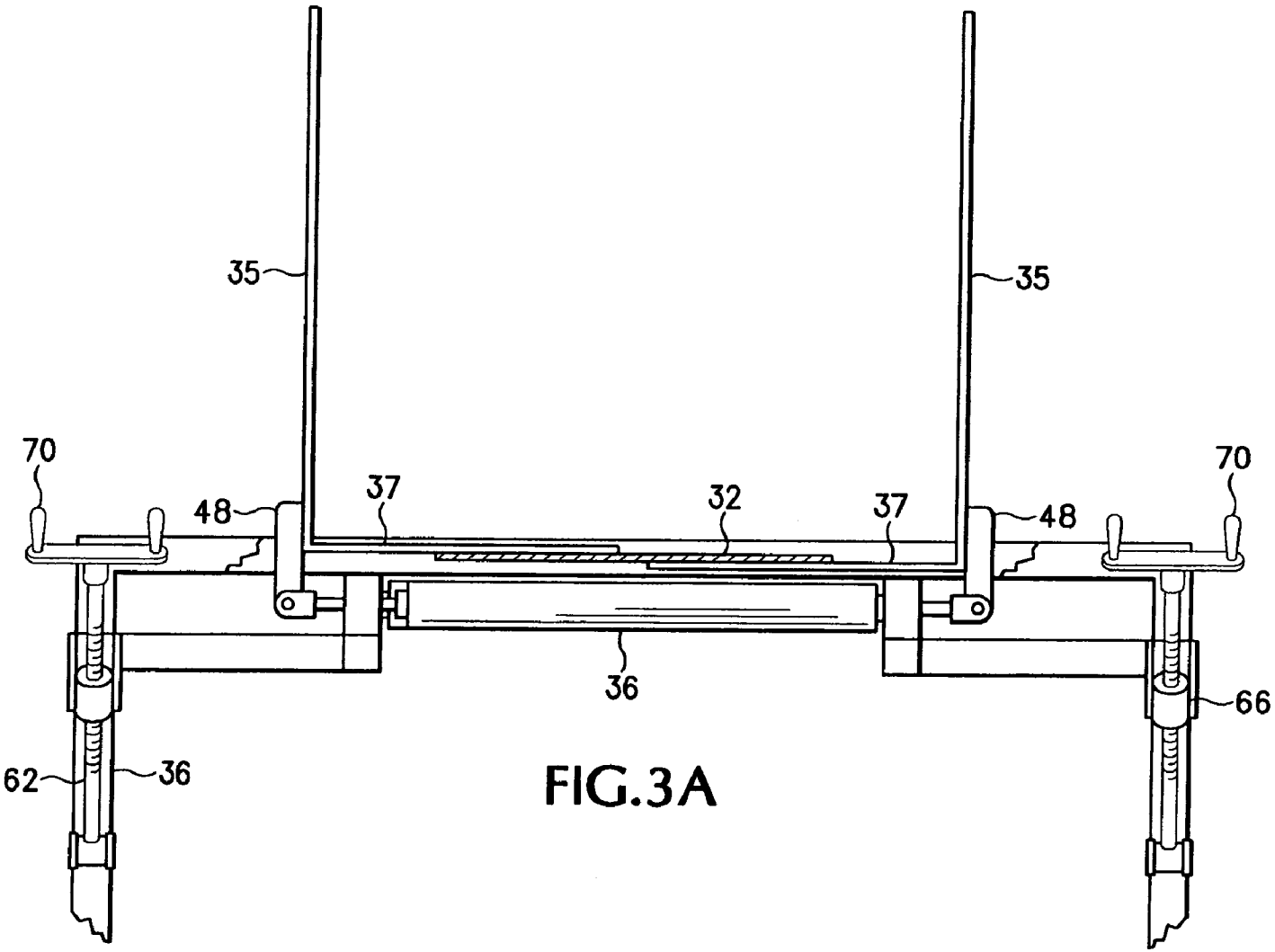
FIG. 3A is a plan view of the central front portion of FIG. 1 taken along view line 3-3 of FIG. 2, with the smoothing device being placed in a narrow configuration.
Figure 3B:
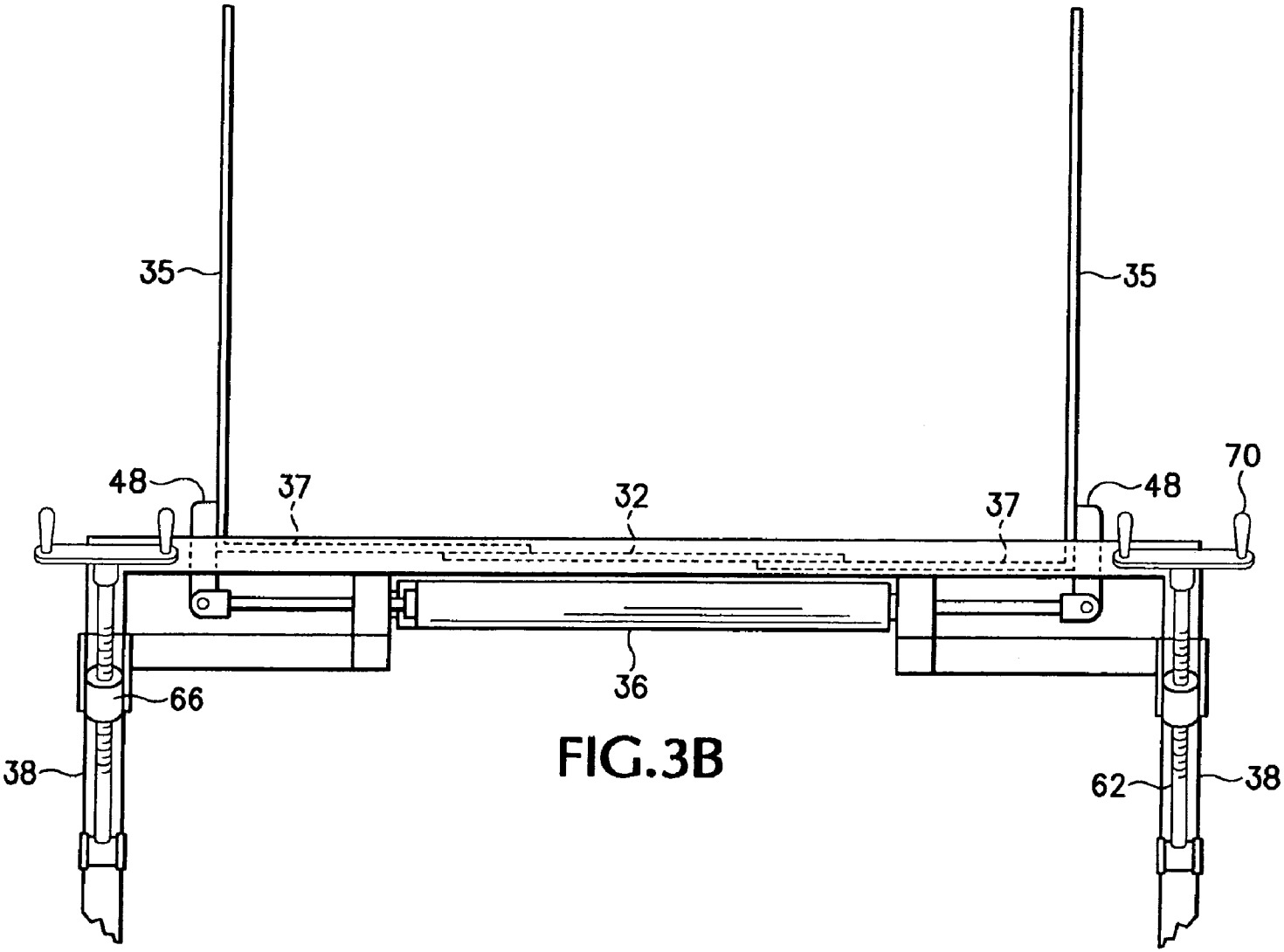
FIG. 3B is a plan view of the central front portion of FIG. 1 taken along view line 3-3 of FIG. 2, with the smoothing device being placed in a wide configuration.

Referring to FIGS. 2 and 3A, smoothing device 30 includes a vertical smoothing blade 32 and asphalt side-spill guard units. Referring to FIG. 3A, each side-spill guard unit is a unitary metal piece made up of a guard blade portion 35 and a smoothing blade portion 37, which is parallel to and directly behind or before blade 32. Taken together, blade 32 and blade portions 37 can be said to form a smoothing blade assembly.

A pair of hydraulic cylinders 36 (FIGS. 4A and 4B) can change the width of the smoothing blade assembly, to accommodate various width trenches. Also, a pair of arms 38, powered by hydraulic cylinders (not shown) raises and lowers smoothing device 30.

Figure 4A:
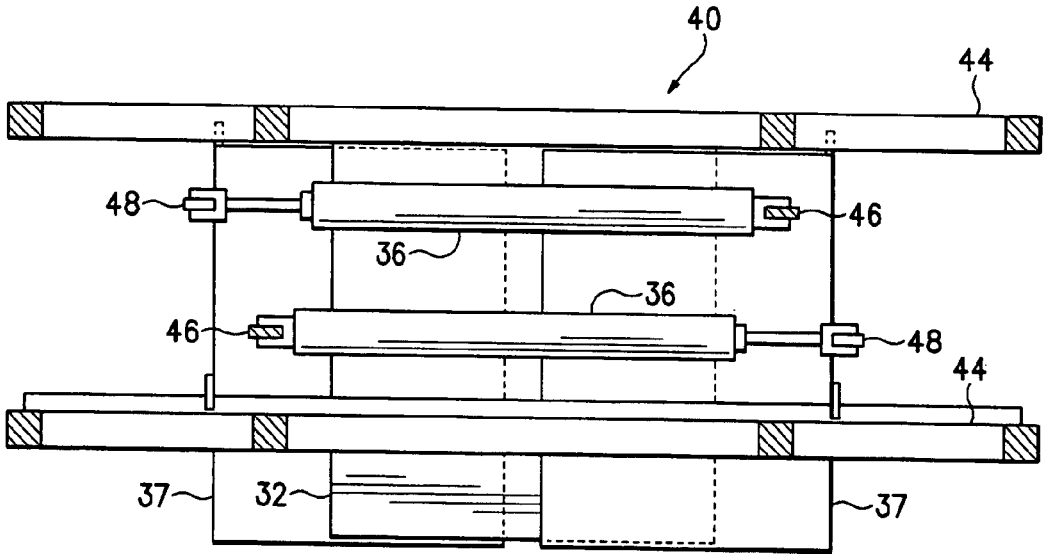
FIG. 4A is a rear view of the central front portion of FIG. 1 taken along view line 4-4 of FIG. 2, with the smoothing device being placed in a narrow configuration.
Figure 4B:
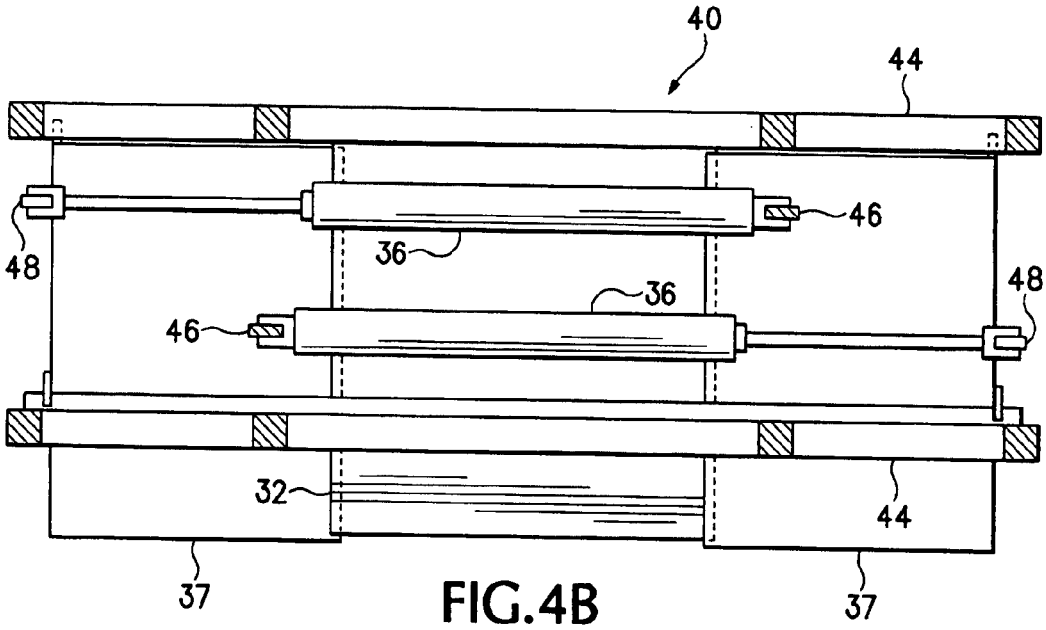
FIG. 4B is a rear view of the central front portion of FIG. 1 taken along view line 4-4 of FIG. 2, with the smoothing device being placed in a wide configuration.

Referring to FIGS. 2, 4A and 4B, a frame 40 is supported by arms 38 and supports device 30. Frame 40 includes a pair of vertical supports 42 and a pair of horizontal supports 44. Hydraulic cylinders 36 are each anchored to a vertical support 42 (FIG. 2), by way of horizontal posts 46, and attached to a smoothing blade portion 37 of a side-spill guard unit by a bracket 48. Using this mechanism, the width of device 30 can be changed continuously from 65 cm to 180 cm, to address varying ditch widths.

A smoothing device tilt compensation mechanism 60 is designed to compensate for the tilt introduced into the smoothing device 30 because of the changing tilt of arms 38, as device 30 is raised and lowered. A threaded shaft 62 is rotatably and pivotably anchored by a shaft bracket 64 and is also in threaded engagement with the interior threads (not shown) of tube 66. In turn, tube 66 is pivotably attached to a tube bracket 68, which is rigidly supported by vertical support 42. Finally, a crank handle 70 at the top of shaft 62 can be rotated, thereby changing the distance between shaft bracket 64 and tube bracket 68. This changes the tilt of device 30.

In an alternative preferred embodiment, device 30 is raised and lowered by hydraulic cylinders that are disposed either directly in front of or directly behind cylinders 36 and which do not introduce a change in tilt to device 30. Although this would reduce the necessity of having the tilt compensation mechanism 60 it has been found that there is some advantage, when working inside a trench, in having guard blades 35 tilted slightly upwardly from rear to front, as this ameliorates the effect of a blade 35 getting snagged on an inwardly projecting rock. Skilled persons may recognize the preferred embodiment shown in the drawings as being a modification of a mini-excavator.

To use tractor 10 for its intended purpose, a trench in a roadway must be largely filled with gravel and a row of asphalt must be laid on top of the gravel. This row of asphalt is typically peaked in the middle, between the two sides of the trench. Tractor 10 is driven to the trench, so that it will straddle it, with one motive force assembly on one side of the trench and the other motive force assembly on the other side of the trench, when the tractor is driven forward.

If more than one layer of asphalt is required, device 30 is lowered so that the bottom edge of blade 32 is below street level. This may require that the tilt mechanism 60 be adjusted to tilt device 30 upwardly relative to arms 38, which will be tilted downwardly. Another measure of upward tilt may be added to device 30 so that it is tilted slightly upwardly, which may be beneficial as noted in the previous paragraph.

The guard units are moved so that the position of guard blades 35 are just narrower then the trench width, so that unit 30 can fit into the trench. Some extra asphalt is placed in front of blade 32 and the tractor is driven forward, pushing the asphalt that is peaked in the middle of the trench off to the side, where it fills in the lower areas. Some trenches have a varying width, due to the need to access underground structures that project off the longitudinal dimension of the trench. When a wider area is encountered, guard blades 35 can be moved outwardly by hydraulic cylinders 36, to widen device 30. When the wider area has been passed, guard blades 35 can be brought back in.

For the top layer, device 30 is placed slightly above the street surface. After device 30 has smoothed the asphalt, a heavy roller is used to compact the asphalt. A sealant may be applied to finish the job. Over the next few days, sand and tack are added at the joints to fill any remaining voids in the joints and create a lasting smooth surface.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A method of smoothing asphalt that has been laid into a trench, to a desired level, said method comprising:

(a) providing a tractor having laterally spaced first and second support and motive force assemblies defining a direction of forward movement and having a smoothing device having a hydraulically adjustable width and including a smoothing blade assembly, having a bottom edge, deployed between a pair of asphalt side-spill guards, aligned to each other and to said direction of forward movement, said smoothing device being hydraulically vertically moveable relative to said motive force assemblies; and (b) using said support and motive force assemblies to move said tractor so that it bridges said trench, and is supported by said first support and motive force assembly on a first side of said trench and said second support and motive force assembly on a second side of said trench;

(c) hydraulically vertically moving said smoothing device so that said bottom edge of said smoothing blade assembly is at said desired level;

(d) hydraulically adjusting said width of said smoothing device to approximately match said width of said trench; and (e) using said support and motive force assemblies to push said tractor forward, thereby causing said smoothing device to push any asphalt above said desired level forward, thereby leaving only asphalt at or below said desired level.

2. The method of claim 1, wherein said support and motive force assemblies are tread assemblies comprising a tread belt driven by drive-wheels.

3. The method claim 1, wherein said support and motive force assemblies are wheels adapted to contact ground.

4. The method of claim 1, wherein said tractor defines a cockpit adapted to accommodate a person and further includes a control assembly adapted to permit said person to adjust said width of said smoothing device while seated in said cockpit.

5. The method of claim 1, wherein said tractor defines a cockpit adapted to accommodate a person and wherein further includes a control assembly adapted to permit a said person to vertically adjust said smoothing device, relative to said support and motive force assemblies.

6. A method of smoothing asphalt that has been laid into a trench having a length and having a first width over a first portion of its length and a second width over a second portion of its length, to a desired level, said method comprising:

(a) providing a tractor having a cockpit and a set of cockpit controls and laterally spaced first and second support and motive force assemblies and having a smoothing device having a cockpit-controlled hydraulically adjustable width and including a smoothing blade assembly, having a bottom edge, deployed between a pair of asphalt side-spill guards, said smoothing device being vertically moveable, by a cockpit control, relative to said motive force assemblies; and (b) using said support and motive force assemblies to move said tractor so that it bridges said trench, and is supported by said first support and motive force assembly on a first side of said trench and said second support and motive force assembly on a second side of said trench;

(c) vertically moving said smoothing device so that said bottom edge of said smoothing blade assembly is at said desired level below said roadway surface;

(d) using said cockpit controls to adjust said width of said smoothing device to approximately match said first width; and (e) using said support and motive force assemblies to push said tractor forward, thereby causing said smoothing device to push any asphalt above said desired level forward, thereby leaving only asphalt at or below said desired level, until said second portion is reached;

(f) using said cockpit controls to adjust said width of said smoothing device to approximately match said second width (g) using said support and motive force assemblies to push said tractor forward, thereby causing said smoothing device to push any asphalt above said desired level forward, thereby leaving only asphalt at or below said desired level, until the end of said second portion is reached.

7. The method of claim 6, wherein all steps in which said width of said smoothing device is adjusted include the action of visually assessing the width of said trench portion.

8. A method of smoothing asphalt that has been laid into a trench defined in a roadway, to a desired level, which is lower than said roadway surface, said method comprising:

(a) providing a tractor having laterally spaced first and second support and motive force assemblies defining a direction of forward movement and having a smoothing device having a hydraulically adjustable width and including a smoothing blade assembly, having a bottom edge, deployed between a pair of asphalt side-spill guards, aligned to each other and to said direction of forward movement, said smoothing device being hydraulically vertically moveable relative to said motive force assemblies; and (b) using said support and motive force assemblies to move said tractor so that it bridges said trench, and is supported by said first support and motive force assembly on a first side of said trench and said second support and motive force assembly on a second side of said trench;

(c) vertically moving said smoothing device so that said bottom edge of said smoothing blade assembly as well as the bottom of the asphalt side-spill guards is at said desired level below said roadway surface;

(d) adjusting said width of said smoothing device to approximately match said width of said trench; and (e) using said support and motive force assemblies to push said tractor forward, thereby causing said smoothing device to push any asphalt above said desired level forward, thereby leaving only asphalt at or below said desired level.

9. The method of claim 8, wherein said tractor defines a cockpit adapted to accommodate a person and further includes a control assembly adapted to permit said person to adjust said width of said smoothing device while seated in said cockpit.

10. The method of claim 9, wherein said step of adjusting said width of said moving device, includes the action of visually assessing the width of the trench and using the control assembly to adjust said width of said smoothing device.

11. The method of claim 8, wherein said tractor defines a cockpit adapted to accommodate a person and further includes a control assembly adapted to permit a said person to vertically adjust said smoothing device, relative to said support and motive force assemblies.

12. The method of claim 8, wherein at the end of step (c) said asphalt side spill guards have an upward tilt from back to front.

* * * * *